US006306268B1

(12) United States Patent
May et al.

(10) Patent No.: US 6,306,268 B1
(45) Date of Patent: Oct. 23, 2001

(54) DEVICE FOR CARRYING OUT CONTINUOUS ELECTROLYTIC PRECIPITATION

(75) Inventors: Hans Josef May, Iserlohn; Roland Schnettler, Hagen, both of (DE); Michel Collard, Bastogne (BE)

(73) Assignees: Circuit Foil, S.A. of Luxemburg, Luxembourg; a part interest; Andritz-Patentverwaltungs-Gesellschaft mbH,, Graz, both of (AT); a part interest ( * ) Notice: Subject to any disclaimer, the term of this patent is extended or adjusted under 35 U.S.C. 154(b) by 0 days.

(21) Appl. No.: 09/403,244

(22) PCT Filed: Apr. 11, 1998

(86) PCT No.: PCT/EP98/02117

§ 371 Date: Dec. 21, 1999

§ 102(e) Date: Dec. 21, 1999

(87) PCT Pub. No.: WO98/48083

PCT Pub. Date: Oct. 29, 1998

(30) Foreign Application Priority Data

Apr. 18, 1997 (DE) ..... 197 16 369

(51) Int. Cl.[7] ..... C25D 17/00
(52) U.S. Cl. ..... 204/224 R; 204/206; 204/212
(58) Field of Search ..... 204/212, 224 R, 204/206

(56) References Cited

U.S. PATENT DOCUMENTS 4,784,740 * 11/1988 Murakami et al. ..... 204/206
5,618,391 * 4/1997 May et al. ..... 204/212

FOREIGN PATENT DOCUMENTS

0261691A1 3/1988 (EP) .
0752485 A1 1/1997 (EP) .

* cited by examiner

*Primary Examiner*—Kathryn Gorgos
*Assistant Examiner*—Wesley A. Nicolas
(74) *Attorney, Agent, or Firm*—Flanagan & Flanagan; John R. Flanagan; John K. Flanagan

(57) ABSTRACT

A device (1) for carrying out continuous electrolytic precipitation processes has a cathodic live cylinder (3) whose top surface is electroconductive over its whole useful width. An anode A is arranged concentrically to and spaced apart from the cathodic live cylinder (3). An electrolyte flows through the space (6) separating the live cylinder (3) from the anode A. Shielding strips (9, 9') associated to the live cylinder (3) are located between the cathodic surface of the live cylinder (3) and the anode A and electrically shield the marginal regions of the live cylinder (3), thus protecting them from electrolytic coating. The useful region N of the live cylinder (3) for carrying out the electrolytic precipitation processes is located between the shielding strips (9, 9'). The side of the shielding strips (9, 9') facing the useful region N has a shoulder (25') which reduces to zero the thickness of a metal strip to be produced or coated on one side, in the marginal region of the metal strip up to the shielding strip edge, so that no coating is deposited on the live cylinder outside the useful region N. The device (1) is useful both for electrolytically producing metal strips and for electrolytically coating one side of metal strips.

12 Claims, 3 Drawing Sheets

DEVICE FOR CARRYING OUT CONTINUOUS ELECTROLYTIC PRECIPITATION

BACKGROUND OF THE INVENTION

The invention relates to a device for carrying out continuous electrolytic precipitative deposition processes comprising a rotating cathodic live cylinder with an electrically conductive surface over its entire usable width and one or more anodes disposed, for example, concentrically and spaced apart with respect to the live cylinder and through the spacing volume between the live cylinder and the anode flows an electrolyte comprising in dissolved form the metal to be precipitated, with which live cylinder at margin regions thereof are disposed means for preventing a coating of the margin regions not used by the live cylinder during the electrolytic deposition processes.

A device for producing electrolytically metal strips is known for example from U.S. Pat. No. 2,044,415. A driven cathodic live cylinder forms a spacing volume with anodes disposed concentrically with the cylindrical surface of the live cylinder, which anodes are disposed encompassing the live cylinder for example over an angle of 160 degrees. Through the spacing volume flows the electrolyte comprising the metal to be precipitated. During a current flow the metal, initially comprised in the electrolyte in dissolved form, is deposited on the cathodic surface of the live cylinder. Due to the rotating movement of the live cylinder, the electrolytic coating can subsequently be pulled off as a foil or thin metal strip after it emerges from the electrolyte and can be continuously supplied to succeeding working steps. In the case of this known live cylinder the entire width of the live cylinder is utilized for the electrolytic precipitative deposition processes for forming the metal foil. In order for the live cylinder not to be subjected to an electrolytic coating in its margin region in the transition to its front faces, which would lead to damage of the same, a rubber band which in cross section is circular is used which is supported on the front-face edge of the live cylinder and on a nonconductive flange disposed on the front face of the live cylinder. This sealing rubber band ensures that a current flow toward the front sides of the live cylinder, and thus an electrolytic coating of these regions, is effectively prevented.

Due to the prevention in the margin, as a consequence of the gap, of electrolytic deposition, this prior known device is only suitable for the production of metal strips or foils of a single width, namely the width of the live cylinder. However, this device is unsuitable in order to produce metal strips of varying widths. This known device is also not intended for the single-side electrolytic coating of metal strips.

A device for single-side electrolytic coating of metal strips is known from WO 94/10360. In contact with and disposed about the driven cathodic live cylinder is guided a metal strip to be coated on the outside. The metal strip is supplied via a deflection roller with minimum spacing to the live cylinder and, after the coating, conveyed further on the opposing side via a further deflection roller. The metal strip passes through a spacing volume through which flows an electrolyte, in which the metal strip is coated electrolytically. The spacing volume formed by the strip surface and the anode disposed opposingly is limited laterally by sealings which can be set in the axial direction of the live cylinder for matching them to different widths of metal strips to be coated. These sealings are each supported with a sealing segment in the margin region of the metal strip to be coated.

These supported sealing segments contact the surface of the metal strip to be coated at an angle of wrap which is of such a magnitude that a sufficient tightness exists when the metal strip enters the electrolyte.

With such a device, metal strips of varying widths can be coated on a single side. Since, due to the sealing measures, these portions are not wetted with electrolyte, the portions of the live cylinder not used in the case of narrow metal strip widths are protected against electrolytic coating. Even if with this known device undesirable electrolytic coating of the unused margin regions of the live cylinder is prevented, in particular in the case of coating very thin metal strips, for example foils, the support of the sealing segments on the metal strips represents a disadvantage. Especially in the case of very thin metal strips to be coated these sealing segments, past which the metal strip to be coated is pulled, leave marks. The margin portions of such strips or foils must subsequently be detached in a succeeding working step.

With an object according to WO 94/10360 the electrolytic metal strip production cannot be carried out.

Building on this discussed prior art the invention is therefore based on the task of proposing a device according to the species in which not only the usable region of the live cylinder is settable and the unused regions of the live cylinder are effectively protected against undesirable electrolytic coating, but with which electrolytic metal strip production as well as single-side electrolytic coating of metal strips is possible.

SUMMARY OF THE INVENTION

This task is solved according to the invention thereby that associated with the live cylinder on each side is a shielding strip projecting beyond the cylindrical surface of the live cylinder and comprising an electrically insulating material, which is disposed between the cathodic live cylinder and the anode(s) and bordering on a usable region utilized by the live cylinder for electrolytic deposition processes, and electrically shielding a margin region of the live cylinder not used during the deposition process and encompassing the live cylinder at least at the level of filling of the electrolyte, with an inner side of the shielding strip facing toward the usable region comprising a shoulder extending over the length of the shielding strip.

By providing a shielding strip, usefully of a flexible strip comprising an electrically nonconductive material, which is disposed such that it encompasses the live cylinder in the region of the electrolyte, an electrically effective shielding is generated between the anode(s), which usefully is/are nondetachable, and the margin regions of the live cylinder, serving as the cathode, covered by the shielding strip. An electric current flow between the anode and the cathode therefore only takes place in the usable region of the live cylinder not covered by the shielding strips such that the electrolytic coating is restricted to the particular usable region of the live cylinder. In contrast, in the margin regions of the live cylinder covered by the shielding strips, current flow, and thus also electrolytic coating, does not take place. In order to ensure that also in the margin portion of the shielding strip, facing the usable region of the live cylinder, an increased electrolytic coating of the live cylinder surface is prevented by the shoulder formed on the shielding strip and directed toward the live cylinder. It is thereby achieved that in the outer, a layer thickness exists which toward the strip edge is decreased to zero such that also no coating of the live cylinder takes place outside the usable region.

The usable region of the live cylinder can be determined, for example, thereby that for different deposition processes shielding strips of different widths are provided such that they shield the live cylinder at the margin regions thereof.

The device according to the invention is suitable for the electrolytic production of metal strips or foils as well as for the single-side electrolytic coating of metal strips since the device utilizes for the protection of the unused live cylinder margin regions the principle of electric shielding and not the principle of fluid sealing, such as is used, for example, in the case of the subject matter of WO 94/10360. For the single-side electrolytic coating of metal strips the margin region of the metal strip to be coated engages the shoulders of the shielding strips, facing toward the usable region of the live cylinder, such that the lateral edge of the metal strip is already electrically shielded to the extent that excessive coating of this metal strip portion and coating of the live cylinder in that margin region which borders directly on the region covered by the metal strip to be coated is protected against electrolytic coating.

Each of the two flexible shielding strips used for shielding are usefully disposed such that they project beyond the opposite axial ends of the cathodic live cylinder. The margin portions of the shielding strips projecting beyond the opposite ends of the live cylinder can be used to set the two shielding strips so as to match them to the width of the usable region of the live cylinder and thus to the width of the margin regions of the live cylinder to be shielded. By employing the margin portions of these shielding strips thus the usable width of the live cylinder can be set by displacing the shielding strips to the particular desired width of the usable region without a change of the shielding strips needing to be carried out.

On its surface facing toward the live cylinder each shielding strip, supported on the surface of the live cylinder, usefully comprises support webs and drainage grooves disposed so as to alternate with the support webs. The drainage grooves provide paths for electrolyte drainage directly from the spacing volume. Furthermore, in particular in the case of thin metal strips to be coated, such as for example foils, through the generation of suction a pressing of the foil, especially at its margin regions, onto the live cylinder takes place, which enhances the proper fixing of the foil on the live cylinder.

Each shielding strip preferably has retaining means on its outer side facing away from the usable region of the live cylinder and projecting beyond a respective one of the opposite axial ends of the live cylinder which engages an adjustment device for setting the strips with respect to the width of the particular live cylinder margin region to be shielded. As provided in an embodiment example, the retaining means are webs spaced apart from one another and held in a receiving groove of a receiving piece implemented so as to be approximately complementary of the webs. The spacing of the webs is selected such that threading of one of the shielding strips into such a receiving piece is facilitated. Such a receiving piece usefully engages a piston-cylinder arrangement of the adjustment device with which the setting of the one shielding strip takes place with respect to the width of the live cylinder margin region to be shielded. However, other means for setting the receiving pieces, such as for example spindles, if appropriate driven by a motor, are conceivable.

BRIEF DESCRIPTION OF THE DRAWINGS

Additional advantages and further developments of the invention will be understood from the following description of a preferred embodiment example with reference to the drawings in which.

DETAILED DESCRIPTION OF THE INVENTION

Figure 1:
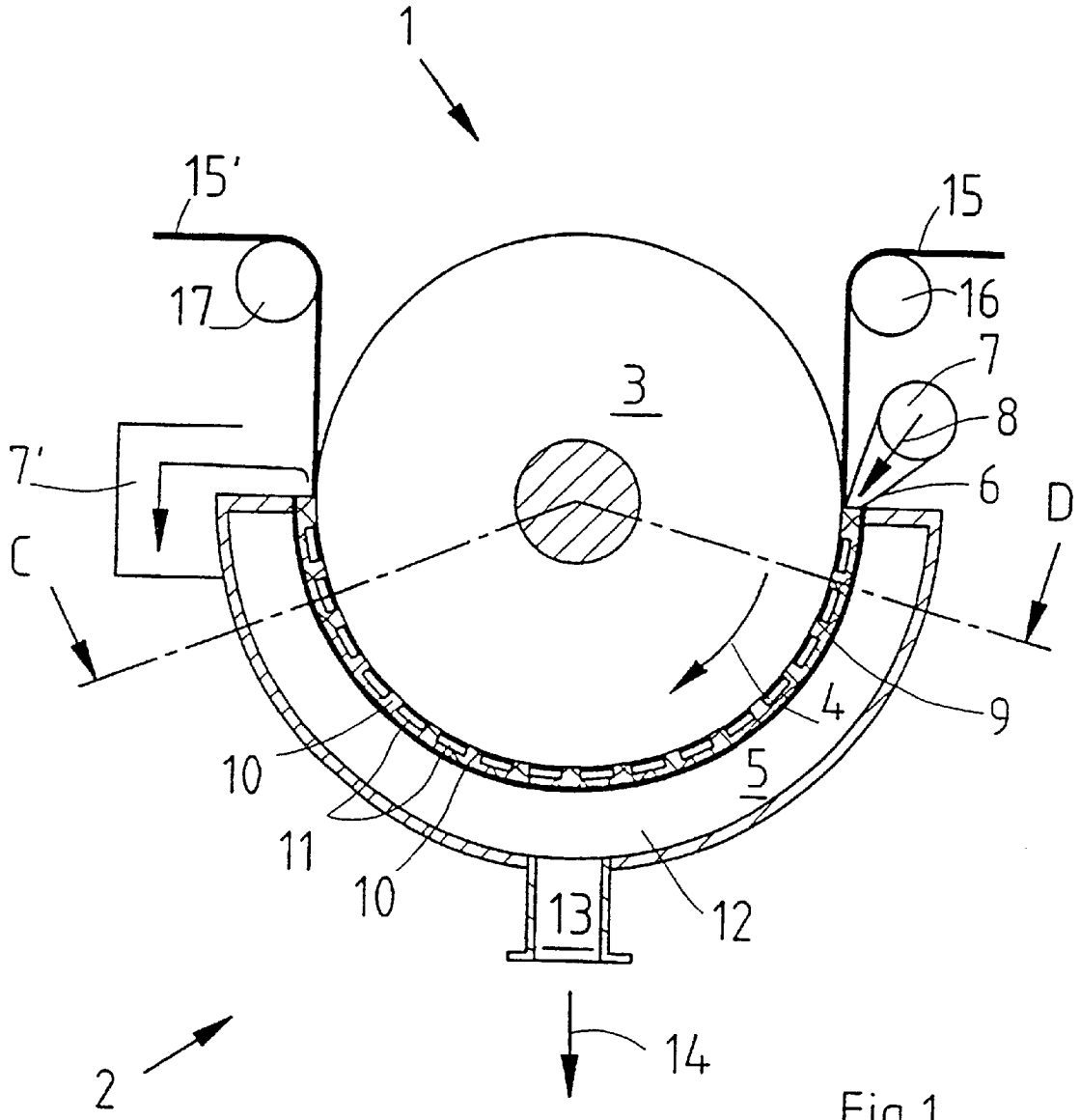
FIG. 1 is a cross-sectional view through a device of the invention for single-side electrolytic coating of metal strips taken along line A–B of FIG. 2.
Figure 2:
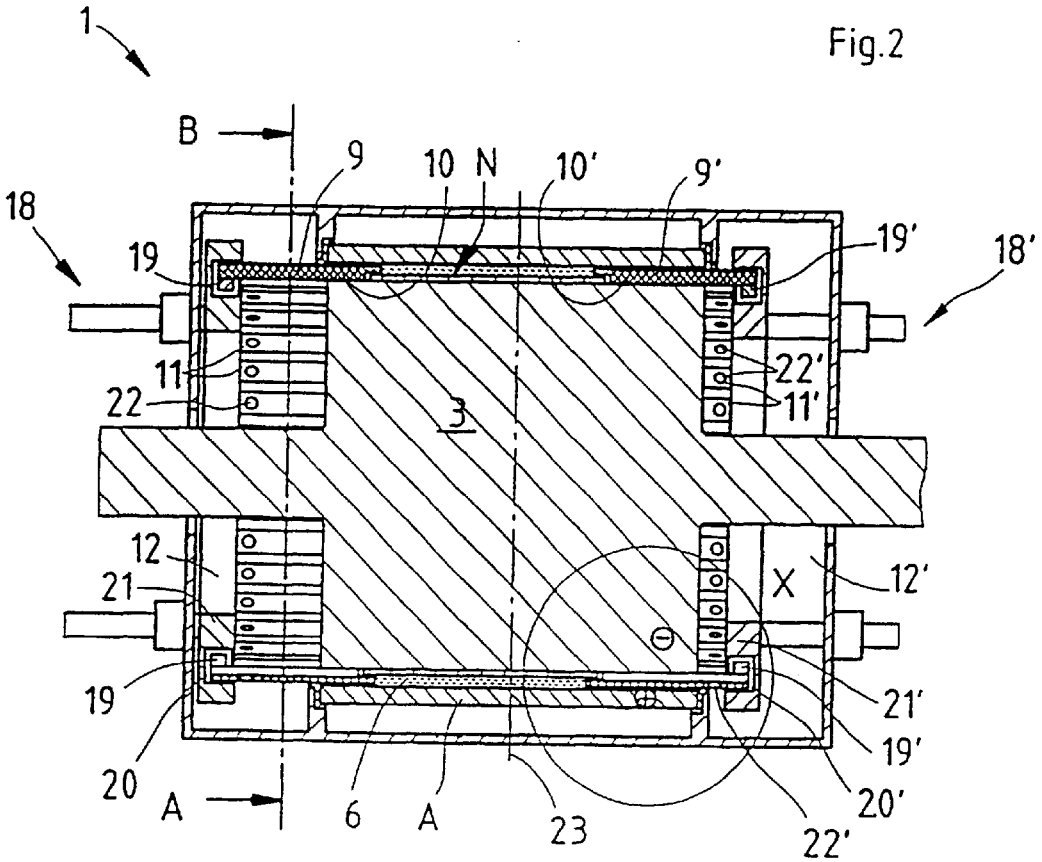
FIG. 2 is a longitudinal sectional view through the device of FIG. 1 taken along line C–D of FIG. 1.
Figure 3:
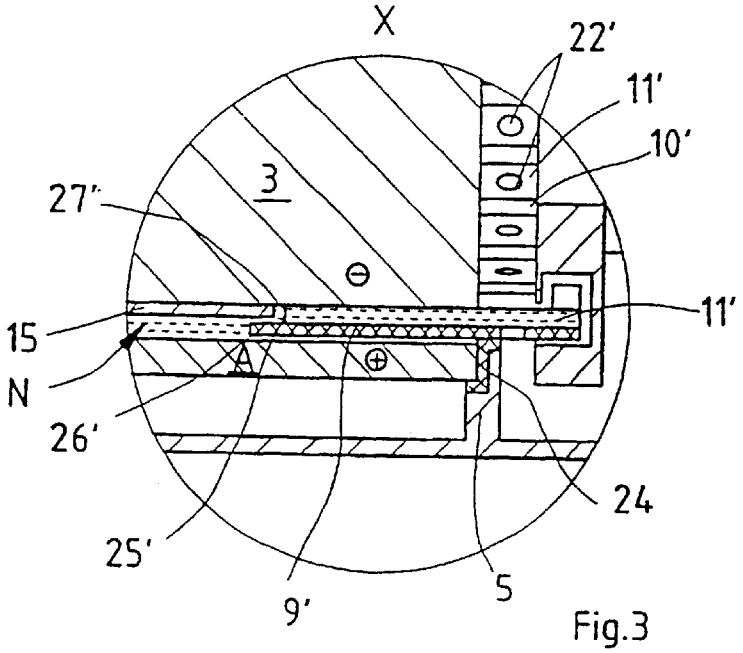
FIG. 3 is an enlarged detailed view of a region enclosed by a circle labeled "X" of FIG. 2.

FIGS. 1 to 3 depict a device 1 for single-side electrolytic coating of metal strips 15. The coating device 1 comprises a trough 2 in which a cathodic live cylinder 3 is rotatably supported. The direction of rotation of the live cylinder 3 is indicated by an arrow 4. The live cylinder 3 is an undivided live cylinder whose cylindrical surface is implemented so as to be electrically conductive over the entire width of the live cylinder. By providing such an undivided live cylinder 3 marks occurring in particular in coating thin metal strips 15, such as develop when using divided live cylinders, are avoided. The necessary anodes A are shown in FIGS. 2 and 3 as being spaced radially outward from the cylindrical surface of the live cylinder 3, but are not evident in the cross-section depicted in FIG. 1 in view that the anodes A are located behind a support wall 5. The anodes A used are nondetachable anodes. Through a spacing volume 6 formed between the surface of the live cylinder 3 and the anodes A flows an electrolyte which is introduced continuously via an electrolyte infeed 7 into the spacing volume 6 and is drawn off via a device 7'. The infeed direction of the electrolyte is indicated by an arrow 8. The direction of flow of the electrolyte is thus in the same direction as the direction of rotation 4 of the live cylinder 3. In a further embodiment example, not shown, it is provided that the direction of flow of the electrolyte is counter to the direction of rotation 4 of the live cylinder 5. The spacing volume 6 is limited at the margin regions of the live cylinder 3 by shielding strips 9, 9', of which in FIG. 1 only the shield strip 9 is evident. The surface of each shield strip 9, 9' facing toward the live cylinder 3 is realized such that it is structured through alternatingly disposed support webs 10 and drainage grooves 11. Each shielding strip 9 is supported with the support webs 10 on the surface to be shielded of the live cylinder 3. The drainage grooves 11 serve for the drainage of the electrolyte in the spacing volume 6 and each terminates at the outside in a collection receptacle 12. At the lowest point of the collection receptacle 12 a drain 13 is disposed from which the electrolyte, draining according to arrow 14 from the drainage grooves 11, is drawn off.

A metal strip 15 to be coated is deflected on a first deflection roller 16 in order to be fed into the spacing volume 6. It is therein provided that before the metal strip 15 enters the spacing volume 6 filled with the electrolyte it is already in contact on the outer side of the cathodic live cylinder 3. During the passage through the spacing volume the desired coating subsequently takes place on the outside of the metal strip 15. The metal strip 15' coated after its passage through the coating device 1 is conveyed further via a second deflection roller 17.

Based on the longitudinal section, shown in FIG. 2, of the coating device 1 the configuration is evident of the two shielding strips 9, 9' with respect to the usable region N of the live cylinder 3. The upper portion of the longitudinal section of FIG. 2 shows the shielding strips 9, 9', which are each shown sectioned in the region of a support web 10, 10', while the shielding strips 9, 9' in the lower portion of this longitudinal section are depicted sectioned in the region of a drainage groove 11, 11'. The shielding strips 9, 9' have a width which ensures that even in the of a metal strip to be coated of least width, they project beyond the opposite axial ends of the liver cylinder 3. These end portions of the shielding strips 9, 9' projecting beyond the opposite axial ends of the live cylinder 3 are engaged by an adjustment device 18, 18' by means of which the shielding strips 9, 9' can be set with respect to the width of the margin regions to be shielded of the live cylinder 3. For this purpose the shielding strips 9, 9' comprise on the outside retaining webs 19, 19' which engage a correspondingly formed receiver 20, 20' of a receiving piece 21. 22. The retaining webs 19, 19' are a multiplicity of discrete webs spaced apart from one another.

In the region of the portions of the shielding strips 9, 9' projecting beyond the front side of the live cylinder 3, drainage openings 22, 22' are placed into the drainage grooves 11, 11', so that electrolyte flowing out can be drained through these drainage openings 22, 22' into the collection receptacles 12, 12' disposed underneath.

Each of the adjustment devices 18, 18' comprises two piston-cylinder arrangements which are supported on the trough 2, by means of which the receiving pieces 21, 21' are axially movable and settable with respect to the live cylinder 3. FIG. 2 shows a configuration of the shielding strips 9, 9' which has been selected solely in order to illustrate the variability of the setting capabilities of the shielding strips 9, 9'. Therein the shielding strip 9 with its adjustment device 18 is shown in a position such as would be selected for generating a relatively wide usable region N, here: for coating a relatively wide metal strip. The shielding strip 9', in contrast, is shown with its adjustment device 18' in a position such as would be selected for forming a relatively narrow usable region N, here: for coating an extremely narrow metal strip. In both cases it is ensured that the regions of the live cylinder 3 not used by the metal strip are electrically shielded by the shielding strips 9, 9' and thus are not subjected to any electrolytic coating. However, in the normal case, the shielding strips 9, 9' are disposed centrally with respect to the center line 23 of the live cylinder 3.

The setting of the shielding strips 9, 9' by means of their adjustment device 18, 18' can take place via a correspondingly positioned photoelectric cell with which the particular width of a metal strip 15 to be coated on the live cylinder 3 is acquired. Via a control unit acted upon by such a photoelectric cell the adjustment devices 18, 18' are subsequently driven for the purpose of setting the shielding strips 9, 9'.

Especially clear is the configuration of the shielding strips 9, 9' based on the enlargement of a segment "X" depicted in FIG. 3 of the shielding strip 9'. The shielding strip 9' is supported with its support web 10' on the outside of the live cylinder 3 and implemented so as to be electrically conductive. Only in the region of the drainage grooves 11' is this margin region of the live cylinder 3 also in contact with the electrolyte. By implementing the shielding strip 9' so as to be electrically nonconductive, this margin region of the live cylinder 3 is, however, electrically shielded such that an electrolytic coating of this margin region is prevented. The shielding strip 9' is held with suitable clamping means in contact with the outside of the live cylinder 3. Between the outside of the live cylinder 3 and the shielding strip 9' therefore a sliding contact exists. In the direction of rotation 4 of the live cylinder the shielding strips 9, 9' are supported at the end side of a stop.

On the outside the shielding strip 9' is supported on the anode mount 24 received in the support wall 5, with the shielding strip 9' comprising a slidingly sealed contact for its settability in the longitudinal direction of the live cylinder 3. In the anode mount 24 is held the anode A.

In a further embodiment example, not shown, it is provided that the shielding strips 9, 9' are pressed with pressure means supported on the anode mount 24 against the surface of the live cylinder 3. As such pressure means can be provided for example inflatable tubing.

The side, facing toward the metal strip 15, of the shielding strip 9' comprises a shoulder 25' whose height is matched to the thickness of the metal strip 15 to be received. Through the shoulder 25' is formed a projection 26' which projects at the outside beyond the outer margin region of the metal strip 15. Through the projection 26' projecting beyond the metal strip 15 the coating of the outermost margin region of the metal strip up to the strip edge is decreased to a layer thickness of zero such that no coating of the live cylinder outside of the usable region N takes place.

Based on the disposition of the shielding strip 9' it is evident that with it an effective electrical shielding of the regions, not covered by the metal strip 15, of the live cylinder 3 is attained without means for attaining a fluid sealing needing to be provided in order to keep the electrolyte away from this region. It is in particular evident based on FIG. 3 that the metal strip 15 is guided freely in shoulder 25' without contact with the shielding strip 9'.

Figure 4:
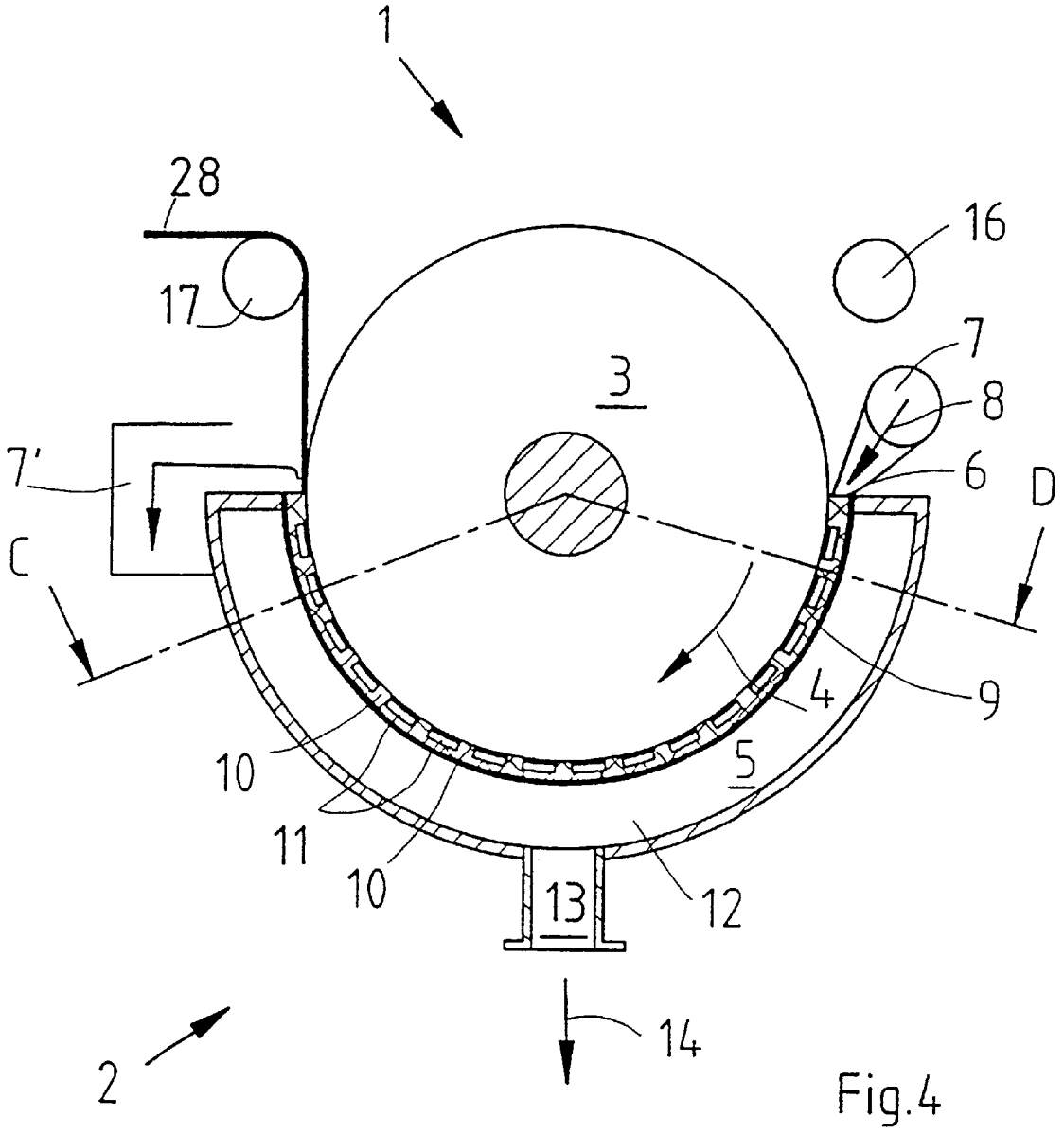
FIG. 4 is a view similar to that of FIG. 1 but of the device set up for electrolytic metal strip production.

FIG. 4 depicts the coating device 1 with the coating device 1 now being set for the electrolytic metal strip production. The infeeding via the deflection roller 16 of a metal strip to be coated therefore does not take place. During a current flow on the cylindrical surface of the live cylinder 3 a metallic deposit is deposited which, in the region in which the live cylinder 3 exits from the spacing volume 6, is pulled from it via the deflection roller 17 through the rotation of the live cylinder 3. The metal strip 28 produced in this way can subsequently be continuously supplied to further working processes or it can be rolled up for intermediate storage. The surface of the live cylinder 3 is conditioned for this purpose such that it is ensured that the metallic deposit formed on the live cylinder surface shows only low adherence capability and thus can be readily pulled off.

For setting the desired width of the metal strip to be produced, the shielding strips 9, 9' are set such that the usable region N of the live cylinder corresponds to the width of the metal strip 28 to be produced. Due to the capability of setting the shielding strips 9, 9', the device 1 is suitable for the production of metal strips of differing widths.

Based on the described embodiment examples it is evident that without carrying out any changes the coating device 1 is suitable for the single-side electrolytic coating of metal strips as well as also for the production proper of metal strips by means of electrolysis. The variability with respect to the capability of setting by way of the shielding strips 9, 9' permits the universal application of device 1.

COMPILATION OF REFERENCE SYMBOLS

1 Coating device
2 Trough
3 Live cylinder
4 Arrow
5 Support wall
6 Spacing volume
7 Electrolyte infeed

8 Arrow
9, 9' Shielding strip
10, 10' Support web
11, 11' Drainage groove
12, 12' Collection receptacle
13 Drain
14 Arrow
15 Metal strip
16 Deflection roller
17 Deflection roller
18, 18' Adjustment device
19, 19' Retaining web
20, 20' Receiver
21, 21' Receiving piece
22, 22' Drainage opening
23 Center line
24 Anode mount
25' Shoulder
26' Projection
27' Margin gap
28 Metal strip
A Anode
N Usable region of the live cylinder

What is claimed is:

1. Apparatus for accomplishing continuous electrolytic precipitative deposition processes, said apparatus comprising:

(a) a rotating cathodic live cylinder having opposite axial ends and a surface of a width extending between said opposite axial ends and being electrically conductive entirely over said width of said surface;

(b) at least one anode disposed approximately concentrically with and radially outwardly from said surface of said live cylinder so as to define a spacing volume therebetween in which flows an electrolyte having in a dissolved form a metal to be deposited; and (c) a pair of shielding strips each comprised of an electrically insulating material and having opposite inner and outer portions, said shielding strips being spaced apart from one another and at said inner portions thereof being disposed in said spacing volume between said anode and said surface of said live cylinder and extending along opposite margin regions on said surface of said live cylinder respectively located adjacent to and contiguous with said opposite axial ends of said live cylinder so as to define a usable region on said surface of said live cylinder extending between said opposite margin regions thereof and oppositely bordered by said shielding strips such that said usable region is electrically exposed to said anode and thus available to be utilized during an electrolytic precipitative deposition process, said shielding strips at said inner portions thereof also entirely overlying said opposite margin regions on said surface of said live cylinder such that said opposite margin regions are entirely electrically shielded from said anode by said shielding strips and thus said opposite margin regions are not available to be utilized during the electrolytic precipitative deposition process so as to prevent a deposit of a coating of the dissolved metal of the electrolyte on said opposite margin regions of said surface of said live cylinder, said shielding strips further being disposed so as to encompass said opposite margin regions on said surface of said live cylinder coextensively with where the electrolyte fills said spacing volume, said shielding strips at said outer portions thereof extending in opposite directions from said spacing volume to beyond said anode and said opposite axial ends of said live cylinder.

2. Apparatus according to claim 1 wherein said shielding strips have respective lengths and at said inner portions thereof have shoulders defined thereon which extend over said respective lengths of said shielding strips and face toward and oppositely border said usable region on said surface of said live cylinder so as to ensure that an excessive deposit of the coating of the dissolved metal of the electrolyte does not occur at said usable region of said surface of said live cylinder adjacent to said margin regions thereon.

3. Apparatus according to claim 1 wherein said shielding strips also are supported on said margin regions of said surface of said live cylinder which are to be shielded by said shielding strips.

4. Apparatus according to claim 1 wherein said shielding strips have respective lengths and surfaces facing toward said margin regions of said surface of said live cylinders, said surfaces including supporting webs and electrolyte drainage grooves being disposed so as to alternate with one another and oriented to extend transversely to said respective lengths of said shielding strips from said inner portions to said outer portions thereof.

5. Apparatus according to claim 4 wherein said discharge grooves on said surfaces of said shielding strips have outer ends with discharge apertures defined therein.

6. Apparatus according to claim 1 further comprising:

a pair of receivers each disposed adjacent to and supporting in a sealing manner a respective one of said shielding strips at said outer portion thereof, said anode extending between and also supported by said receivers.

7. Apparatus according to claim 1 further comprising:

an adjustment device coupled to said outer portions of said shielding strips and being operable to movably relocate said shielding strips relative to and along said surface of said live cylinder so as to change respective portions of said width of said surface of said live cylinder defined as said usable region thereof and as said margin regions thereof.

8. Apparatus according to claim 7 wherein said adjustment device includes a pair of piston-and-cylinder arrangements being operable for movably relocating said shielding strips.

9. Apparatus according to claim 7 wherein said adjustment device includes a pair of arcuate-shaped receiver parts having respective grooves defined in sides thereof facing toward said shielding strips such that said grooves receive said outer portions of said shielding strips, said receiver parts being adjustable toward and away from said opposite axial ends of said live cylinder.

10. Apparatus according to claim 9 wherein said adjustment device further includes a pair of piston-and-cylinder arrangements being operable for movably relocating said receiver parts and thereby said shielding strips received in said grooves of said receiver parts.

11. Apparatus according to claim 9 wherein each of said shielding strips also has a plurality of webs formed in spaced apart relation to one another on said outer portion of said shielding strips and coupled to a respective one of said receiver parts.

12. Apparatus according to claim 1 wherein said shielding strips have respective surfaces facing toward said margin regions of said surface of said live cylinders and a coating on said respective surfaces adapted to reduce friction between said surfaces of said shielding strips and said margin regions of said surface of said live cylinder.

* * * * *